United States Patent [19]

Jarrett et al.

[11] 4,167,373

[45] Sep. 11, 1979

[54] FUEL INJECTION PUMPING APPARATUS

[75] Inventors: Boaz A. Jarrett, Sevenoaks; Paul Lakra, Wembley HAO IBL, both of England

[73] Assignee: C.A.V. Limited, Birmingham, England

[21] Appl. No.: 471,688

[22] Filed: Apr. 30, 1974

[30] Foreign Application Priority Data

May 11, 1973 [GB] United Kingdom ..... 22475/73

[51] Int. Cl.[2] ..... F04B 49/00

[52] U.S. Cl. ..... 417/289; 60/464; 417/399

[58] Field of Search ..... 417/390, 398–401, 417/346, 344, 322, 289, 502, 345, 500; 91/50; 60/464, 584

[56] References Cited

U.S. PATENT DOCUMENTS

| | | | |
|---|---|---|---|
| 1,564,215 | 12/1925 | Dillig | 417/289 X |
| 2,156,415 | 5/1939 | Weihe | 60/584 X |
| 2,463,552 | 3/1949 | Newhall | 417/346 X |
| 2,834,295 | 5/1958 | Hjarpe | 417/344 |
| 2,909,315 | 10/1959 | Sampietro | 417/401 |
| 3,326,135 | 6/1967 | Smith | 417/345 |
| 3,411,704 | 11/1968 | Hilgert et al. | 417/326 |
| 3,461,910 | 8/1969 | Selsam et al. | 310/8.3 |
| 3,487,783 | 1/1970 | Curran et al. | 417/399 X |
| 3,500,799 | 3/1970 | Benson | 123/32 EA |
| 3,822,679 | 7/1974 | Hobo et al. | 123/139 E |

*Primary Examiner*—Carlton R. Croyle
*Assistant Examiner*—Edward Look
*Attorney, Agent, or Firm*—Holman & Stern

[57] ABSTRACT

A fuel injection pumping apparatus comprises a displacement piston which is located within the cylinder, an outlet from one end of the cylinder and a fluid pressure operable member mounted within a further cylinder for actuating the piston and causing fuel to be delivered through the outlet. Means is operable upon movement of the displacement piston to a predetermined position to terminate delivery of fuel through the outlet and valve means is provided to control the application of fluid under pressure to the fluid pressure operable member.

10 Claims, 3 Drawing Figures

FUEL INJECTION PUMPING APPARATUS

This invention relates to fuel injection pumping apparatus and has for its object to provide such an apparatus in a simple and convenient form.

According to the invention, a fuel injection pumping apparatus comprises in combination, a displacement piston located within a cylinder, an outlet from one end of the cylinder, a fluid pressure operable member mounted within a further cylinder for actuating said piston and causing fuel to be delivered through said outlet, means operable upon movement of the piston to a predetermined position in said cylinder during delivery of fuel through said outlet by the piston, to terminate flow of fuel through the outlet and valve means operable to place an end of said further cylinder in communication with a source of fluid under pressure to effect movement of the displacement piston in a direction to deliver fuel through said outlet, or with a drain to permit return motion of the piston.

According to a further feature of the invention, said valve means is operated by means of a stack of piezo-electric crystals.

Figure 1:
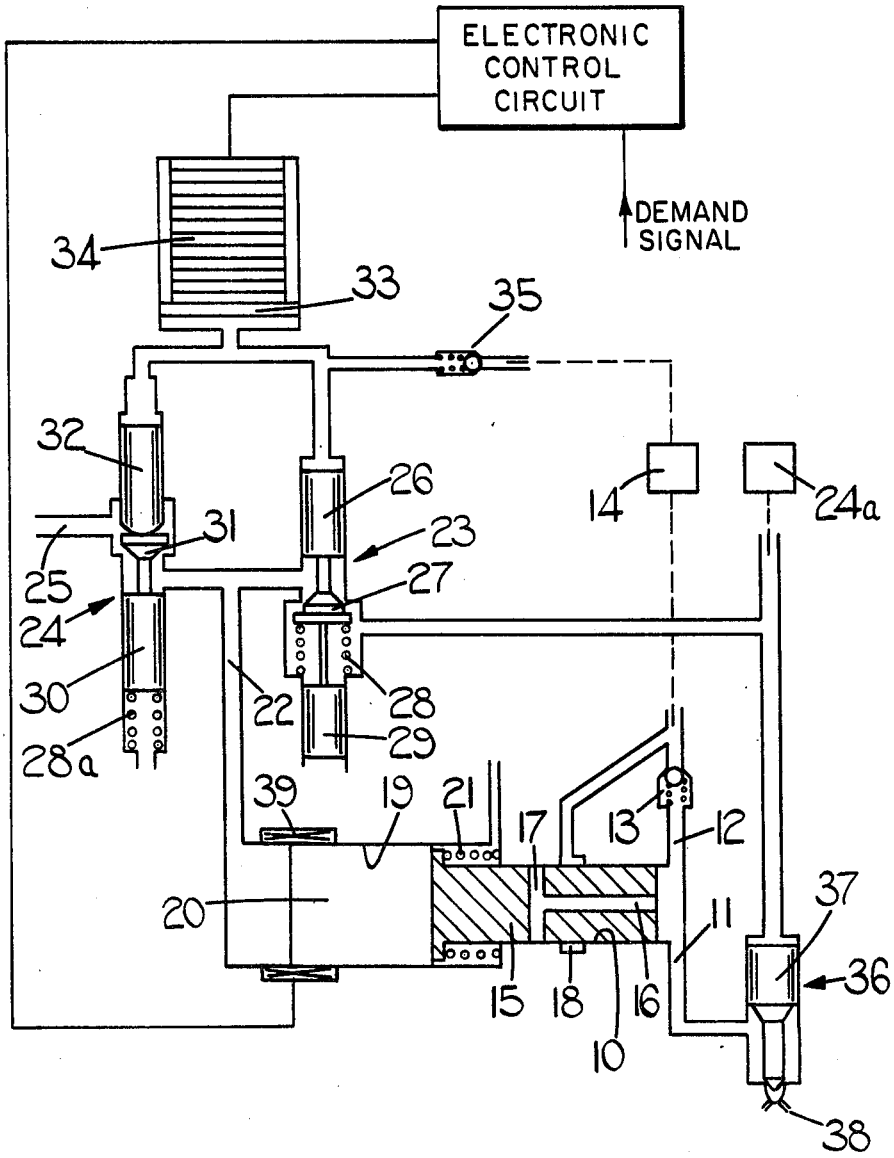
Figure 2:
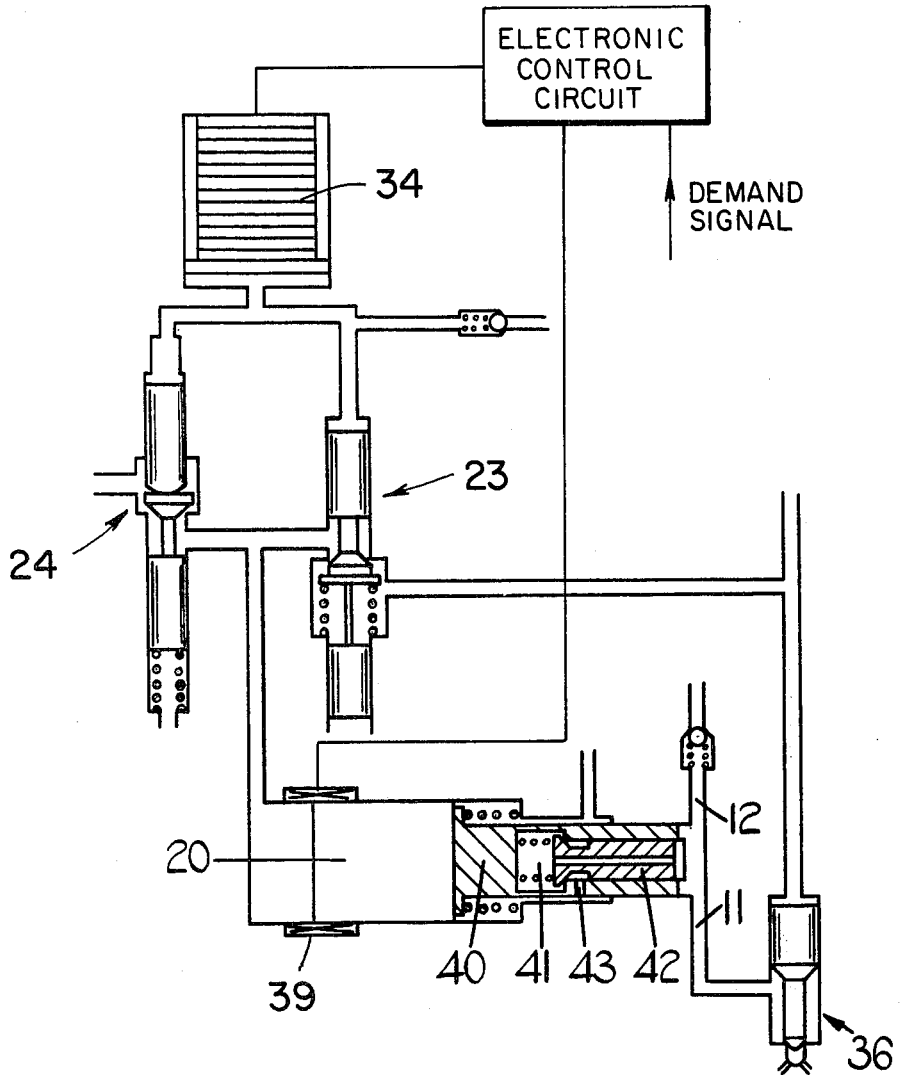

Examples of fuel injection pumping apparatus in accordance with the invention will now be described with reference to the accompanying drawings in which:

FIGS. 1, and 2 show different examples of apparatus in diagrammatic form.

Referring to FIG. 1 of the drawings, there is provided a cylinder 10, one end of which communicates with an outlet 11 and a fuel inlet 12, the latter being connected by way of a non-return valve 13 to a source 14 of fuel. Located within the cylinder 10 is a displacement piston 15. Formed in the piston is an axially extending drilling 16 and this communicates with a cross drilling 17 which at a predetermined position of the displacement piston as it moves to deliver fuel through the outlet 11, communicates with a spill gallery 18, the latter communicating with the source of fuel 14.

Also provided is a further cylinder 19 which is disposed co-axially with the cylinder 10, and this contains a fluid pressure operable member 20. The cylinder 19 is larger in diameter than the cylinder 10, and the space surrounding the displacement piston 15 is vented to a drain. Moreover, the displacement piston 15 is provided with a coiled compression spring 21 which acts to move the piston together with the member 20 in a direction away from said outlet 11.

The other end of the further cylinder 19 is connected to a passage 22 which can be connected by way of a first valve 23 to an accumulator **24*a* which contains liquid preferably fuel, at a high pressure. Alternatively, the passage 22 may be connected by way of a valve 24 to a drain passage 25**.

The valve 23 includes a pressure actuated valve member 26 having an integral head 27. The head 27 is loaded into contact with a seating by means of a coiled compression spring 28, and in this position the supply of liquid from the accumulator 24 to the passage 22 is broken. In addition, the valve member 26 is provided with a pressure balancing element 29.

The second valve 24 includes a slidable valve element 30 including a head 31 which can co-operate with a seating to prevent flow of liquid from the passage 22 to the drain passage 25. The valve element 30 is spring loaded by a spring **28*a* in a direction to open the valve and it is moved to the closed position by means of a valve actuating piston 32. The piston 32 can be subjected to a fluid pressure developed by a piston 33 which is operated by means of a stack 34 of piezo-electric crystals. In addition, the pressure developed by the piston 33 is applied to the valve member 26. The piston 33 is moved to develop a pressure upon energisation of the stack of crystals, and it has the effect of closing the valve 24 and opening the valve 23. The cylinder occupied by the piston 33, together with the chambers communicating therewith are maintained full of liquid conveniently fuel, by way of a non-return valve 35**.

As shown in the drawing, the outlet 11 is connected to an injection nozzle 36 which includes a differential valve 37 of the usual type. This valve is urged into contact with a seating to prevent flow of fuel through orifices 38 into a combustion space of an associated engine by the application of fluid pressure from the accumulator **24*a***.

In operation, the valves 23 and 24 are shown in the position which they adopt during return motion of the member 20 and displacement piston 15 under the action of the spring 21, but also under the action of fuel flowing past the non-return valve 13. After a predetermined movement, as will be explained, the stack of crystals 34 is partly energised and the piston 33 develops fluid pressure which is applied to effect reversal of the piston of the valve 24. Valve 23 remains unaffected because the force exerted by the spring 28 is higher than the spring **28*a*. The valves remain in this position until the desired time for injection whereupon the stack is fully energised and the valve 23 is opened. In this situation, pressure from the accumulator 24*a* is applied to the end of the member 20 and this effects movement of the displacement piston so as to pressurise the fuel in the outlet 11. When a predetermined pressure has been reached which it will be understood, is higher than the accumulator pressure, the valve member of the injector 36 is lifted and flow of fuel occurs through the outlet 11 and through the orifices 38 to a combustion space of the engine. This flows of fuel continues until the transverse drilling 17 is brought into register with the spill gallery 18. At this point, the pressure in the outlet 11 falls, and any surplus fuel displaced by continued movement of the displacement piston, flows through the drillings 16 and 17 to the spill gallery 18. Moreover, the valve member of the injection nozzle is closed onto its seating by the predominating pressure from the accumulator 24*a*. It will be appreciated of course that the pressure of fuel delivered to the outlet 11 is higher than the accumulator pressure by virtue of the fact that the area of the end of the member 20** which is exposed to the accumulator pressure, is greater than the area of the end of the displacement piston.

The stack of crystals 34 is maintained in its fully energised state for a sufficient length of time to allow the pressure in passage 11 to fall to the feed pressure of the source 14. At this point the crystals are de-energised and the valves 23, 24 return to the positions shown in the drawing. In addition, the displacement piston 15 together with the pressure operable member 20 move under the action of the spring 21 and the fuel pressure supplied by way of the non-return valve 13. The time allowed for the return motion as described determines the amount of fuel which is supplied to the engine and this is carefully controlled by an electronic control circuit which supplies electrical power to the stack of crystals 34. When it is required to deliver more fuel to the engine, the displacement piston and the member 20 are allowed a longer time for their return motion. The stroke of the member 20 is sensed by a sensing coil 39 and the signal developed by this coil is applied to the electronic control circuit. This circuit then makes appropriate adjustments to the return time of member 20 so that the desired stroke is maintained.

The arrangement which is shown in FIG. 2 is essentially identical to that which is shown in FIG. 1. The only difference lies in the construction of the displacement piston 40. In this arrangement, the piston 40 is provided with a valve chamber 41 which accommodates the head of a valve member 42, the body of the valve member 42 projecting beyond the end of the displacement piston 40. Moreover, the valve member 42 is spring loaded so that its head engages a seating defined about the wall of the chamber 41. Moreover, the chamber 41 communicates with the outlet 11 by way of an axial drilling in the valve member. The space beneath the head of the valve member communicates by way of a cross drilling 43 with a drain, and conveniently the cylinder which accommodates the displacement piston 40 is slightly enlarged over a portion of its length, for this purpose.

The operation of this arrangement is the same as the arrangement described in FIG. 1, except that the termination of delivery of fuel through the outlet 11 occurs when the protruding portion of the valve member engages with the end of the cylinder in which the displacement piston is mounted.

We claim:

1. A fuel injection pumping apparatus comprising in combination, a displacement piston located within a cylinder, an outlet and a fuel inlet at one end of the cylinder, a one-way valve in said fuel inlet for permitting fuel to flow only into said inlet, a fluid pressure operable member mounted within a further cylinder for actuating said piston and causing fuel to be delivered through said outlet, means operable upon movement of the piston to a predetermined position in said cylinder during delivery of fuel through said outlet by the piston, to terminate flow of fuel through said outlet, valve means operable to place an end of said further cylinder in communication with a source of fluid under pressure to effect movement of the displacement piston in a direction to deliver fuel through said outlet, or with a drain to permit return motion of the piston, the apparatus including means controlling the operation of said valve means, a control circuit operable to control the means controlling operation of said valve means, and sensing coil means positioned to sense the position of the fluid pressure operable member mounted within said further cylinder to provide a signal to the control circuit indicative of the position of the displacement piston, the extent of the return motion of the displacement piston being controlled to determine the quantity of fuel discharged through said outlet during movement of the piston by said fluid pressure operable member.

2. A fuel injection pumping apparatus comprising in combination, a displacement piston located within a cylinder, an outlet from one end of said cylinder, a fluid pressure operable member mounted within a further cylinder for actuating said piston and causing fuel to be delivered through said outlet, means operable upon movement of the piston to a predetermined position in said cylinder during delivery of fuel through said outlet by the piston, to terminate flow of fuel through the outlet, valve means operable to place an end of said further cylinder in communication with a source of fluid under pressure to effect movement of the displacement piston in a direction to deliver fuel through said outlet, or with a drain to permit return motion of the piston, a source of fuel under pressure, a non return valve through which said source of fuel is in communication with said one end of the cylinder, and in which said valve means comprises first and second spring loaded valve elements, said first valve element being spring loaded to the open position to place said end of the further cylinder in communication with the drain and said second valve element being spring loaded to the closed position, said second valve element when in the open position placing said one end of the further cylinder in communication with said source of fluid.

3. An apparatus according to claim 2 including an actuating piston movable to generate a control pressure, and surfaces against which said control pressure generated by the actuating piston acts, said surfaces being associated with said valve elements respectively.

4. An apparatus according to claim 3 including a stack of piezo electric crystals operatively associated with said actuating piston, and an electronic control circuit for energising said stack of crystals thereby to generate said control pressure.

5. An apparatus according to claim 4 in which the force exerted by the spring associated with said first valve element is less than the force exerted by the spring associated with said second valve element whereby operation of said control circuit to effect partial energisation of the stack of piezo electric crystals causes closing of said first valve element without causing opening of said second valve element, said first valve element when closed acting to halt the return motion of the displacement piston.

6. An apparatus according to claim 5 including means for providing a signal to the electronic control circuit indicative of the position of the displacement piston.

7. An apparatus according to claim 6 in which said means comprises a sensing coil positioned to sense the position of the fluid pressure operable member.

8. An apparatus according to claim 7 in which said electronic control circuit receives a signal from said sensing coil and a demand signal indicative of the amount of fuel to be supplied by the apparatus.

9. An apparatus according to claim 7 in which said means for terminating fuel flow through said outlet comprises a drain port formed in the wall of the cylinder containing the displacement piston, and the displacement piston is provided with port means which is brought into register with said drain port at said predetermined position, said port means communicating with said outlet.

10. An apparatus according to claim 7 in which said means for terminating fuel flow through said outlet comprises a valve operable when the displacement piston reaches said predetermined position to place said outlet in communication with a drain.

* * * * *